United States Patent [19]

Knowles

[11] 4,297,785

[45] Nov. 3, 1981

[54] ELECTRIC STARTING AIDS FOR INTERNAL COMBUSTION ENGINES

[75] Inventor: Richard P. Knowles, Farnborough, England

[73] Assignee: Lucas Industries Limited, Birmingham, England

[21] Appl. No.: 114,589

[22] Filed: Jan. 23, 1980

[30] Foreign Application Priority Data

Feb. 24, 1979 [GB] United Kingdom ..... 6630/79

[51] Int. Cl.[3] ..... H05B 3/00

[52] U.S. Cl. ..... 29/611; 219/335

[58] Field of Search ..... 29/611, 515; 219/335, 219/336

[56] References Cited

U.S. PATENT DOCUMENTS

| | | | |
|---|---|---|---|
| 3,934,116 | 1/1976 | Cunningham | 29/611 X |
| 4,035,609 | 7/1977 | Vogel | 29/611 |
| 4,087,904 | 5/1978 | Krug | 29/611 |

*Primary Examiner*—Leon Gilden

[57] ABSTRACT

An electric starting aid includes a tubular extension extending from a body, a central conductor rod supported by an insulating body in the extension. A spirally wound heating element is located in the end of the extension and has its adjacent turns insulated by a glass like substance. In making the aid electric current is passed through the element to soften the glass like substance and the end portion of the extension is then rolled to reduce its diameter.

4 Claims, 2 Drawing Figures

ELECTRIC STARTING AIDS FOR INTERNAL COMBUSTION ENGINES

This invention relates to a method of manufacturing an electric starting aid for an internal combustion engine of the kind comprising a body adapted to be retained in a bore formed in the cylinder head of the engine, an electrically conductive tubular extension located at one end of the body, part of said extension extending in use within a combustion chamber of the engine, a central conductor rod extending through said extension, insulating means supporting said rod within the extension and a spirally wound heating element formed from metallic tape, located in the open end of said extension, said heating element being secured at its inner and outer ends to the central rod and the extension respectively.

An aid of this type is described in the specification of British Pat. No. 1,127,454. As described herein, the heating element is formed from a metallic tape having an insulating coating thereon, the element being spirally wound about the central conductor rod to which the inner end of the element is connected. The outer end of the element is connected to the internal surface of the extension and the central conductor rod is retained in the extension by an insulating sleeve which is located about the rod and has its outer end located adjacent the heating element.

In use, the element is exposed to the severe conditions within the combustion chamber and these conditions are at their most severe when the engine is running at full load and full speed. When operated under these conditions it is found that there is a tendancy for failure of the heating element to occur as a result of vibration by gas pulsation. Various modes of failure are possible e.g. fretting between adjacent turns leading to insulation breakdown, fatigue failure of the tape and failure of the joint between the tape and the rod. During manufacture every effort is made to wind the element as tightly as possible so that the wound element fills the space at the end of the extension but even with these precautions the element does vibrate when the starting aid is in use.

The object of the present invention is to provide a method of making a starting aid of the kind specified whereby the risk in use of vibration of the heating element taking place within the extension is minimised.

According to the invention a method of making a starting aid of the kind specified comprises coating the tape of a glass like substance, securing one end of the tape of the central rod and winding the tape about the central rod, inserting the wound element into the end portion of the extension, securing the rod within the extension, securing the other end of the tape to the extension, passing an electric current through the element so that the latter attains a temperature sufficient to cause softening of the glass like substance and rolling the end portion of the extension to effect a reduction in the diameter thereof.

In the accompanying drawings.

With reference to the drawings, the starting aid comprises a cylindrical body 10 which in use, is retained within a bore formed in the cylinder head of an engine. Extending from the body is a tubular extension 11 the free end portion of which is of reduced wall thickness. The end portion of the extension in use is positioned within the combustion chamber of the engine.

Figure 1:
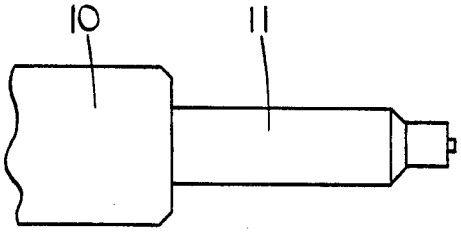
FIG. 1 is an exterior view of a portion of the starting aid.
Figure 2:
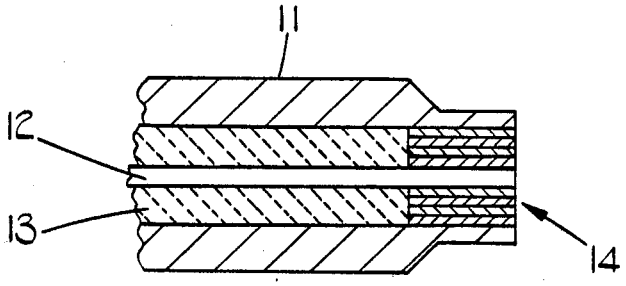
FIG. 2 is a cross section to an enlarged scale, of a portion of the aid seen in FIG. 1.

As shown in FIG. 2, there is extending within the extension 11 a central electrically conductive support rod which is electrically connected to a terminal (not shown) mounted on the body 10. The support rod is supported within the extension by means of a sleeve 13 shown as a single piece but conveniently formed from a ceramic ring disposed adjacent the free end portion, and glass rings may have lower melting points at their distance from the ceramic ring increases. The glass rings are fused to the rod and also to the interior surface of the extension.

Located within the open end portion of the extension is a spirally wound heating element 14 and this is formed from metallic tape with the inner end of the element welded or otherwise secured to the support rod 12 and the outer end of the element secured to the interior surface of the extension 13. When the aforesaid terminal is connected to one terminal of an electric supply with the other terminal of the electric supply connected to earth, an electric circuit is completed through the heating element and the latter is heated to provide in use, a heated surface within the combustion chamber to facilitate the starting of the engine.

The tape prior to it being wound about the support rod 12 to form the heating element, is coated with a frit containing a glass like substance for example, a vitreous enamel which may be fired onto the tape at a temperature of approximately 1050° C. The resultant coating is thin i.e. in the order of between 1.0 and 1.5 hundredths of a millimeter and the coating serves to provide electrical insulation between the adjacent turns of the heating element. The outer end of the element is secured to the inner surface of the extension by for example, welding, and this may include the step of first folding the outer end portion of the tape through 45°, so that the end portion of the tape extends substantially at right angles to the plane of the element. The ceramic and glass rings which will form the sleeve 13 are then placed in position to locate the rod and the glass rings are fused.

The heating element is then supplied with electric current so that it attains a temperature in the order of 950° C. and the reduced end portion of the extension is then rolled conveniently between three rollers, to reduce its diameter by between 10.0 to 20.0%. The temperature to which the element is heated by the electric current is sufficient to soften the vitreous enamel and the effect of reducing the diameter of the extension is to compress the turns of the heating element together. Since the heating element has end portions the effect of rolling the extension is to cause the turns of the heating element to touch only at intervals and at the points or zones of contact the enamel fuses the turns together.

A terminal rod may then be secured to the support rod and the extension mounted within a body. The terminal rod is insulated from the body by further glass rings which are fused. Alternatively a ballast resistor may be connected between the support rod and the terminal mounted on the body.

In one example the frit as applied to the tape comprises an aqueous slurry with 100 parts by weight of glass forming substance, 20 parts by weight of chrome oxide and 4 parts by weight of ball clay. The glass forming substance comprises silica, titanium oxide, boric oxide, alumina and alkali oxides.

In some instances of use liquid fuel can penetrate between the turns of the heating element and lead to the formation of carbon deposits which shorten the life of the heating element by causing breakdown on the insulation of the element. In order to avoid this vacuum impregnation of the turns of the heating element with more of the frit, is effected prior to the heating and rolling operation. In this case therefore the element and the vitreous enamel represent a solid mass which is fused within the extension and the entry of fuel between the turns of the element is prevented. In use, however the starting aid takes longer to reach its operating temperature as compared with a starting aid manufactured as first described.

I claim:

1. A method of manufacturing an electric starting aid for an internal combustion engine of the kind comprising a body adapted to be retained in a bore formed in the cylinder head of the engine, an electrically conductive tubular extension located at one end of the body, part of said extension extending in use within a combustion chamber of the engine, a central conductor rod extending through said extension, insulating means supporting said rod within the extension and a spirally wound heating element formed from metallic tape, located in the open end of said extension, said heating element being secured at its inner and outer ends to the central rod and the extension respectively, the method comprising coating the tape with a glass like substance, securing one end of the tape to the central rod and winding the tape about the central rod, inserting the wound element into the end portion of the extension, securing the rod within the extension, securing the other end of the tape to the extension, passing an electric current through the element so that the latter attains a temperature sufficient to cause softening of the glass like substance and rolling the end portion of the extension to effect a reduction in the diameter thereof.

2. A method according to claim 1 in which the reduction in the diameter of the end portion of the extension is achieved by rolling the end portion between three rollers.

3. A method according to claim 1 including the step of vacuum impregnating using the glass forming substance, the wound heating element prior to the heating and rolling operation.

4. An electric starting aid for an internal combustion engine whenever manufactured in accordance with any one of the preceding claims.

* * * * *